US008150299B2

(12) United States Patent
Iino

(10) Patent No.: US 8,150,299 B2
(45) Date of Patent: Apr. 3, 2012

(54) TONER SUPPLYING APPARATUS AND TONER SUPPLYING METHOD FOR IMAGE FORMING APPARATUS

(75) Inventor: Tomohiro Iino, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 585 days.

(21) Appl. No.: 12/331,917

(22) Filed: Dec. 10, 2008

(65) Prior Publication Data

US 2009/0148188 A1 Jun. 11, 2009

Related U.S. Application Data

(60) Provisional application No. 61/012,772, filed on Dec. 10, 2007.

(51) Int. Cl.
*G03G 15/08* (2006.01)

(52) U.S. Cl. ..... 399/262; 399/111; 399/120; 399/258

(58) Field of Classification Search ..... 399/110, 399/111, 119, 120, 252, 254–260, 262
See application file for complete search history.

(56) References Cited

U.S. PATENT DOCUMENTS

| | | | | |
|---|---|---|---|---|
| 5,045,884 | A * | 9/1991 | Ohira et al. | 399/224 |
| 2003/0215268 | A1* | 11/2003 | Kita | 399/258 |
| 2004/0131390 | A1* | 7/2004 | Kita | 399/258 |

FOREIGN PATENT DOCUMENTS

| | | |
|---|---|---|
| JP | 7 319268 | 8/1995 |
| JP | 11-024513 | 1/1999 |
| JP | 2002-162809 | 6/2002 |
| JP | 2006-091522 | 6/2006 |

* cited by examiner

*Primary Examiner* — David Porta
*Assistant Examiner* — Jessica L Eley
(74) *Attorney, Agent, or Firm* — Patterson & Sheridan, LLP

(57) ABSTRACT

An image forming apparatus includes plural developing devices arranged at a fixed interval, plural toner cartridges arranged at an interval smaller than the interval among the developing devices, and plural sub-hoppers that receive toners stored in the toner cartridges and feed the toners to plural developing devices. The plural sub-hoppers respectively have toner receiving ports formed in positions opposed to toner discharging ports of the toner cartridges and have toner supply ports for feeding toners to the developing devices. The plural sub-hoppers are arranged at an interval same as an arrangement pitch of the developing devices.

19 Claims, 6 Drawing Sheets

TONER SUPPLYING APPARATUS AND TONER SUPPLYING METHOD FOR IMAGE FORMING APPARATUS

CROSS-REFERENCE TO RELATED APPLICATION

This application is based upon and claims the priority of U.S. Provisional Application No. 61/012,772, filed on Dec. 10, 2007, the entire contents of which are incorporated herein by reference.

TECHNICAL FIELD

The present invention relates to an image forming apparatus of an electrophotographic system that superimposes toners of plural colors to obtain a color image and relates to a toner supplying apparatus and a toner supplying method in the image forming apparatus.

BACKGROUND

In general, in an image forming apparatus of an electrophotographic system, plural photoconductive drums are arranged in parallel and laser beams are irradiated on the respective photoconductive drums to form electrostatic latent images. Toner images of respective colors are formed on the photoconductive drums by plural developing devices. The toner images of the respective colors are multiply transferred on to sheet paper to obtain a color image.

The developing devices are provided in the plural photoconductive drums. Plural toner cartridges are arranged to feed toners to the developing devices. The toners stored in the toner cartridges are carried to the developing devices.

In some image forming apparatus, sub-tanks are arranged between the toner cartridges and the developing devices. The sub-tanks are called sub-hoppers and are auxiliary toner tanks provided between the toner cartridges and the developing devices. Since the toners in the toner cartridges are fed to the sub-hoppers, even if there is no toner in the toner cartridges, it is possible to perform printing using the toners in the sub-hoppers.

JP-A-11-24513 discloses a toner supplying apparatus. In the toner supplying apparatus disclosed in JP-A-11-24513, sub-hoppers are arranged between toner cartridges and developing devices.

JP-A-2002-162809 discloses a color image forming apparatus. In the color image forming apparatus disclosed in JP-A-2002-162809, a capacity of a toner hopper for black having different frequency of use is set larger than a capacity of toner hoppers for the other three colors and a pitch among the toner hoppers for the three colors is minimized.

In the conventional image forming apparatus, the plural sub-hoppers are arranged at an interval same as an arrangement pitch of the developing devices. On the other hand, if the plural toner cartridges are arranged at the same interval and the size of the toner cartridge having high frequency of use is increased, the image forming apparatus is structurally increased in size.

If the interval among the plural toner cartridges is set smaller than the interval among the sub-hoppers, the image forming apparatus can be structurally reduced in size. However, since the interval among the toner cartridges and the interval among the sub-hoppers are different, paths for feeding the toners from the toner cartridges to the sub-hoppers are complicated and the number of components increases. When the sub-hoppers are replaced, since there are the plural sub-hoppers, the respective sub-hoppers may be attached in wrong positions.

SUMMARY

According to an aspect of the present invention, there is provided an image forming apparatus, comprising:

plural developing devices that develop electrostatic latent images formed on image bearing members;

plural toner cartridges that store toners to be fed to the plural developing devices and have toner discharging ports, at least one of the toner cartridges having size larger than that of the other toner cartridges and the toner cartridges being arranged such that the toner discharging ports are adjacent to one another at an interval smaller than an arrangement pitch of the plural developing devices; and plural sub-hoppers that respectively have toner receiving ports formed in positions opposed to the toner discharging ports of the plural toner cartridges and have toner supply ports for feeding the toners to the developing devices, the sub-hoppers being arranged such that the toner supply ports are adjacent to one another at an interval same as the arrangement pitch of the plural developing devices.

DETAILED DESCRIPTION

Figure 1:
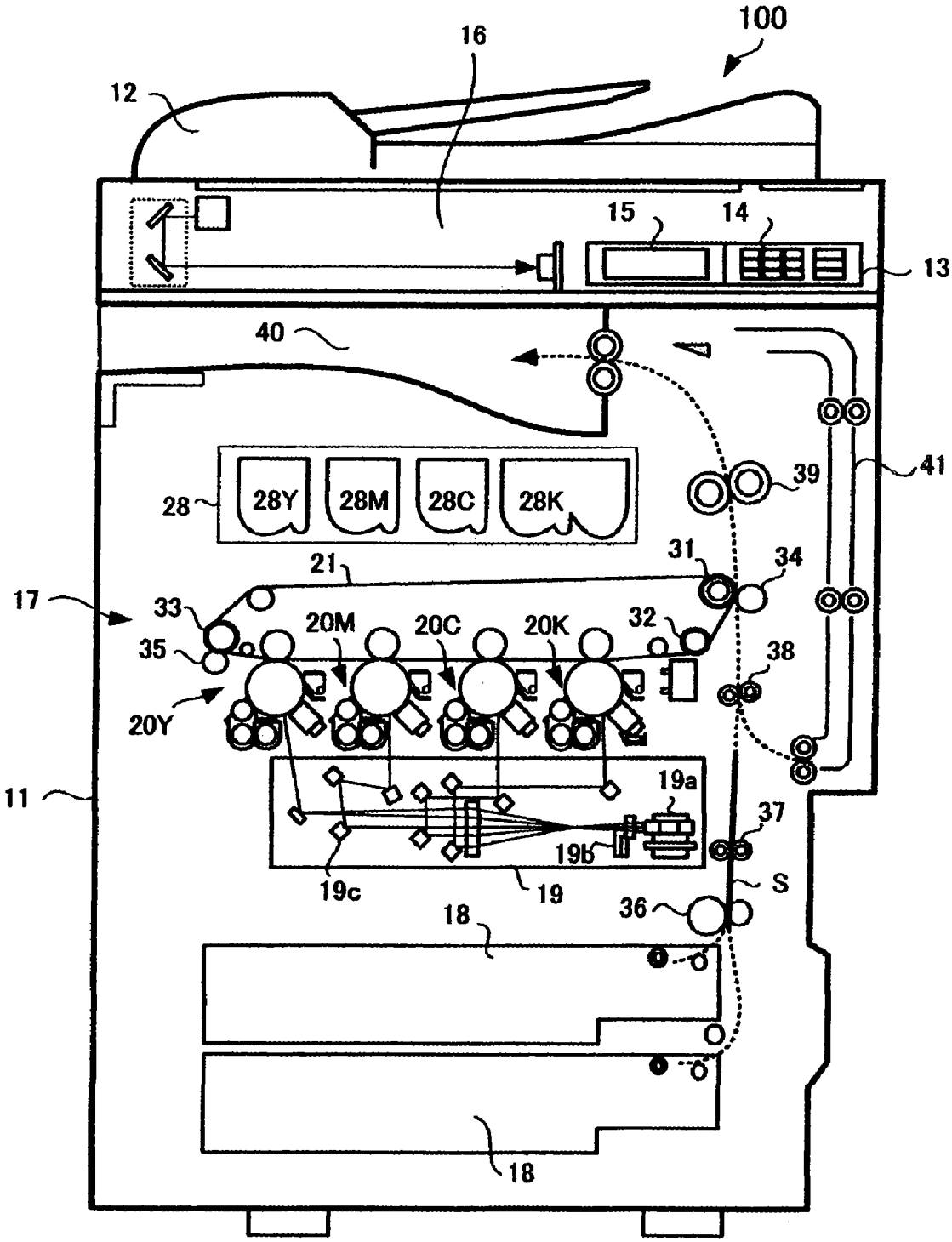
FIG. 1 is a front view of an image forming apparatus according to an embodiment of the present invention.

Throughout this description, the embodiment and example shown should be considered exemplars, rather than limitations on the apparatus of the present invention.

An image forming apparatus according to an embodiment is explained in detail below with reference to the accompanying drawings. In the figures, the same components are denoted by the same reference numerals and signs.

FIG. 1 is a front view of the image forming apparatus according to the embodiment. In FIG. 1, reference numeral 100 denotes an image forming apparatus, for example, an MFP (Multi-Function Peripherals) as a complex machine, a printer, or a copying machine. In the following explanation, the MFP is explained as an example of the image forming apparatus.

A document table (not shown) is provided in an upper part of a main body 11 of the MFP 100. An auto document feeder (ADF) 12 is openably and closably provided on the document table. An operation panel 13 is provided in an upper part of the main body 11. The operation panel 13 has an operation unit 14 including various keys and a display unit 15 of a touch panel type.

A scanner unit 16 is provided in the main body 11 below the ADF 12. The scanner unit 16 scans a document fed by the ADF 12 or a document placed on the document table and generates image data. A printer unit 17 is provided in the center in the main body 11. Plural cassettes 18 that store sheets of various sizes are provided in a lower part of the main body 11.

The printer unit 17 includes photoconductive drums and lasers or the like. The printer unit 17 processes image data scanned by the scanner unit 16 or image data created by a PC (Personal Computer) or the like and forms an image on a sheet (details are explained later).

The sheet having the image formed thereon by the printer unit 17 is discharged to a paper discharge unit 40. The printer unit 17 is, for example, a color laser printer of a tandem system. The printer unit 17 scans photoconductive members with laser beams from a laser exposure device 19 and generates images.

The printer unit 17 includes image forming units 20Y, 20M, 20C, and 20K for respective colors of yellow (Y), magenta (M), cyan (C), and black (K). The image forming units 20Y, 20M, 20C, and 20K are arranged in parallel from upstream to downstream sides on a lower side of an intermediate transfer belt 21. In the following explanation, since the image forming units 20Y, 20M, 20C, and 20K have the same configuration, the image forming unit 20Y is explained as a representative one.

Figure 2:
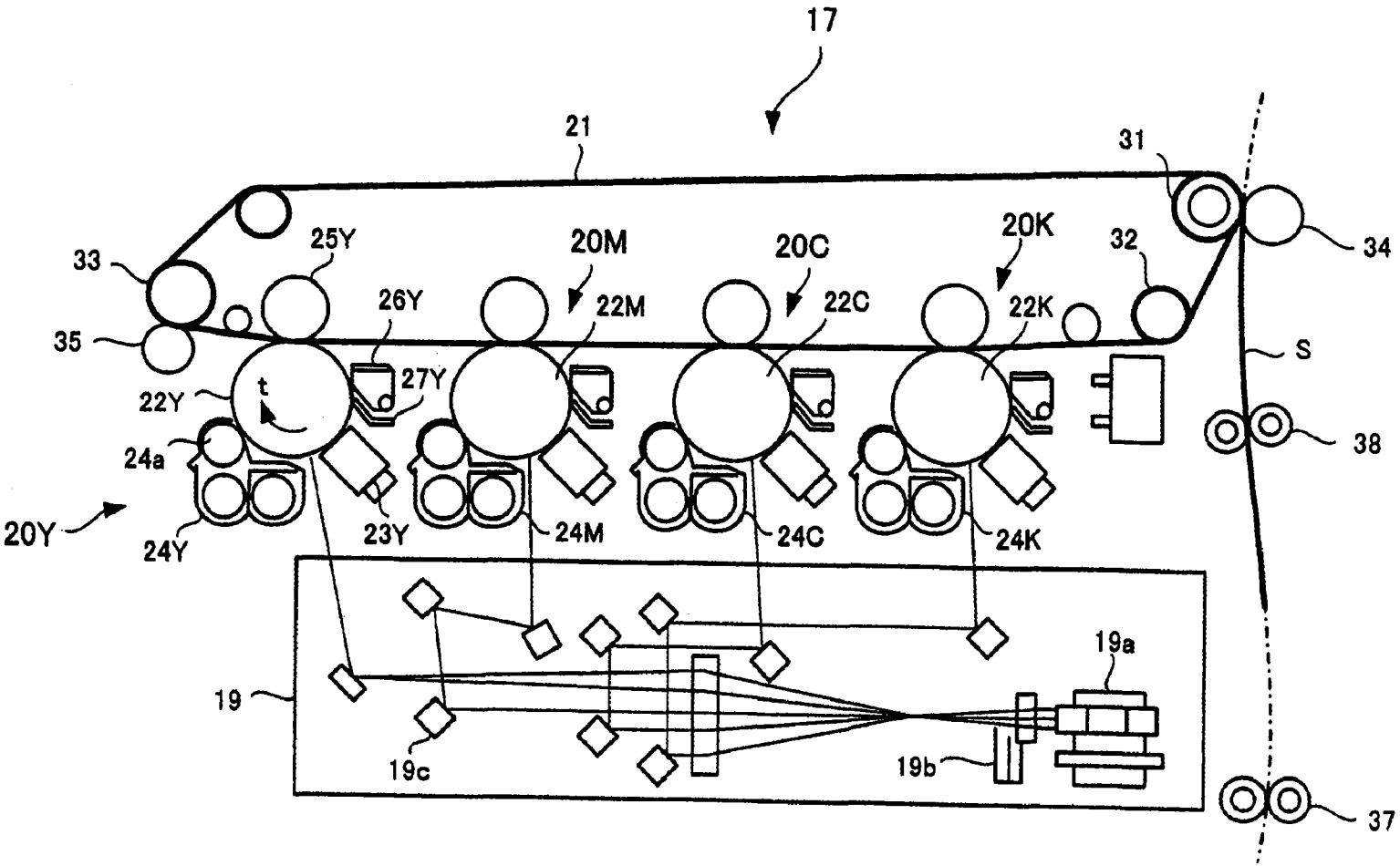
FIG. 2 is a diagram of the internal structure of the image forming apparatus shown in FIG. 1.

The printer unit 17 including the image forming units 20Y, 20M, 20C, and 20K is shown in FIG. 2 in enlargement. As it is seen from FIG. 2, the image forming unit 20Y has a photoconductive drum 22Y as an image bearing member. An electrification charger 23Y, a developing device 24Y, a primary transfer roller 25Y, a cleaner 26Y, a blade 27Y, and the like are arranged along a rotating direction "t" around the photoconductive drum 22Y. A yellow laser beam from the laser exposure device 19 is irradiated on an exposure position of the photoconductive drum 22Y and forms a latent image on the photoconductive drum 22Y.

The electrification charger 23Y of the image forming unit 20Y uniformly charges the entire surface of the photoconductive drum 22Y. The developing device 24Y feeds a two-component developer including a yellow toner and a carrier to the photoconductive drum 22Y using a developing roller 24*a* to which a developing bias is applied. The cleaner 26Y removes a residual toner on the surface of the photoconductive drum 22Y using the blade 27Y.

Toner cartridges 28 (see FIG. 1) that supply the toners to the developing devices 24Y, 24M, 24C, and 24K are provided above the image forming units 20Y, 20M, 20C, and 20K. As the toner cartridges 28, toner cartridges 28Y, 28M, 28C, and 28K for the respective colors of yellow (Y), magenta (M), cyan (C), and black (K) are adjacent to one another.

The sub-hoppers are attached between the toner cartridges 28Y, 28M, 28C, and 28K and the developing devices 24Y, 24M, 24C, and 24K, respectively. However, the sub-hoppers are not shown in FIGS. 1 and 2. The toner supplying apparatus including the sub-hoppers is explained later with reference to FIG. 3 and subsequent figures.

The intermediate transfer belt 21 cyclically moves. For example, semi-conductive polyimide is used for the intermediate transfer belt 21 in terms of heat resistance and abrasion resistance. The intermediate transfer belt 21 is stretched and suspended by a driving roller 31 and driven rollers 32 and 33 and is opposed to and in contact with the photoconductive drums 22Y to 22K. Primary transfer voltage is applied to a position of the intermediate transfer belt 21 opposed to the photoconductive drum 22Y by the primary transfer roller 25Y. A toner image on the photoconductive drum 22Y is primarily transferred onto the intermediate transfer belt 21.

A secondary transfer roller 34 is arranged to be opposed to the driving roller 31 that stretches and suspends the intermediate transfer belt 21. When a sheet S passes between the driving roller 31 and the secondary transfer roller 34, a secondary transfer voltage is applied to the sheet S by the secondary transfer roller 34. The toner image on the intermediate transfer belt 21 is secondarily transferred onto the sheet S. A belt cleaner 35 is provided on the intermediate transfer belt 21 near the driven roller 33.

The laser exposure device 19 includes a polygon mirror 19*a*, a focusing lens system 19*b*, and a mirror 19*c*. The laser exposure device 19 scans laser beams, which are emitted from semiconductor laser elements, in an axial direction of the photoconductive drums 22.

As shown in FIG. 1, a separating roller 36 that extracts the sheet S in the paper feeding cassettes 18, a conveying roller 37, and a registration roller 38 are provided between the paper feeding cassettes 18 and the secondary transfer roller 34. A fixing device 39 is provided downstream of the secondary transfer roller 34.

The paper discharge section 40 and a reverse conveyance path 41 are provided downstream of the fixing device 39. The sheet S is discharged to the paper discharge section 40 from the fixing device 39. The reverse conveyance path 41 reverses the sheet S and guides the sheet S in the direction of the secondary transfer roller 34. The reverse conveyance path 41 is used when duplex printing is performed. Since the reverse conveyance path 41 is not the gist of the present invention, detailed explanation thereof is omitted.

Operations of the image forming apparatus 100 shown in FIGS. 1 and 2 are explained below. When image data is inputted from the scanner 16, the PC, or the like, images are sequentially formed in the image forming units 20Y to 20K.

The image forming unit 20Y is explained as an example. A laser beam corresponding to yellow (Y) image data is irradiated and an electrostatic latent image is formed on the photoconductive drum 22Y. The electrostatic latent image on the photoconductive drum 22Y is developed by the developing device 24Y and a yellow (Y) toner image is formed.

The photoconductive drum 22Y comes into contact with the rotating intermediate transfer belt 21 and primarily transfers the yellow (Y) toner image onto the intermediate transfer belt 21 using the primary transfer roller 25Y. After the toner image is primarily transferred onto the intermediate transfer belt 21, a residual toner on the photoconductive drum 22Y is removed by the cleaner 26Y and the blade 27Y. The photoconductive drum 22Y is prepared for the next image formation.

In the same manner as the process for forming the yellow (Y) toner image, magenta (M), cyan (C), and black (K) toner images are formed by the image forming units 20M to 20K. The respective toner images are sequentially transferred to the position on the intermediate transfer belt 21 where the yellow (Y) toner image is transferred. The yellow (Y), magenta (M), cyan (C), and black (K) toner images are multiply transferred onto the intermediate transfer belt 21 to obtain a full-color toner image.

The full-color toner image on the intermediate transfer belt 21 is secondarily transferred onto the sheet S collectively by a transfer bias of the secondary transfer roller 34. The sheet S is fed from the paper feeding cassettes 18 to the secondary transfer roller 34 synchronously with the full-color toner image on the intermediate transfer belt 21 reaching the secondary transfer roller 34.

The sheet S having the toner image secondarily transferred thereon reaches the fixing device 39 and the toner image is fixed thereon. The sheet S having the toner image fixed thereon is discharged to the paper discharge section 40. After the secondary transfer is finished, a residual toner on the intermediate transfer belt 21 is cleaned by the belt cleaner 35.

A toner supplying apparatus according to this embodiment is explained below.

Figure 3:
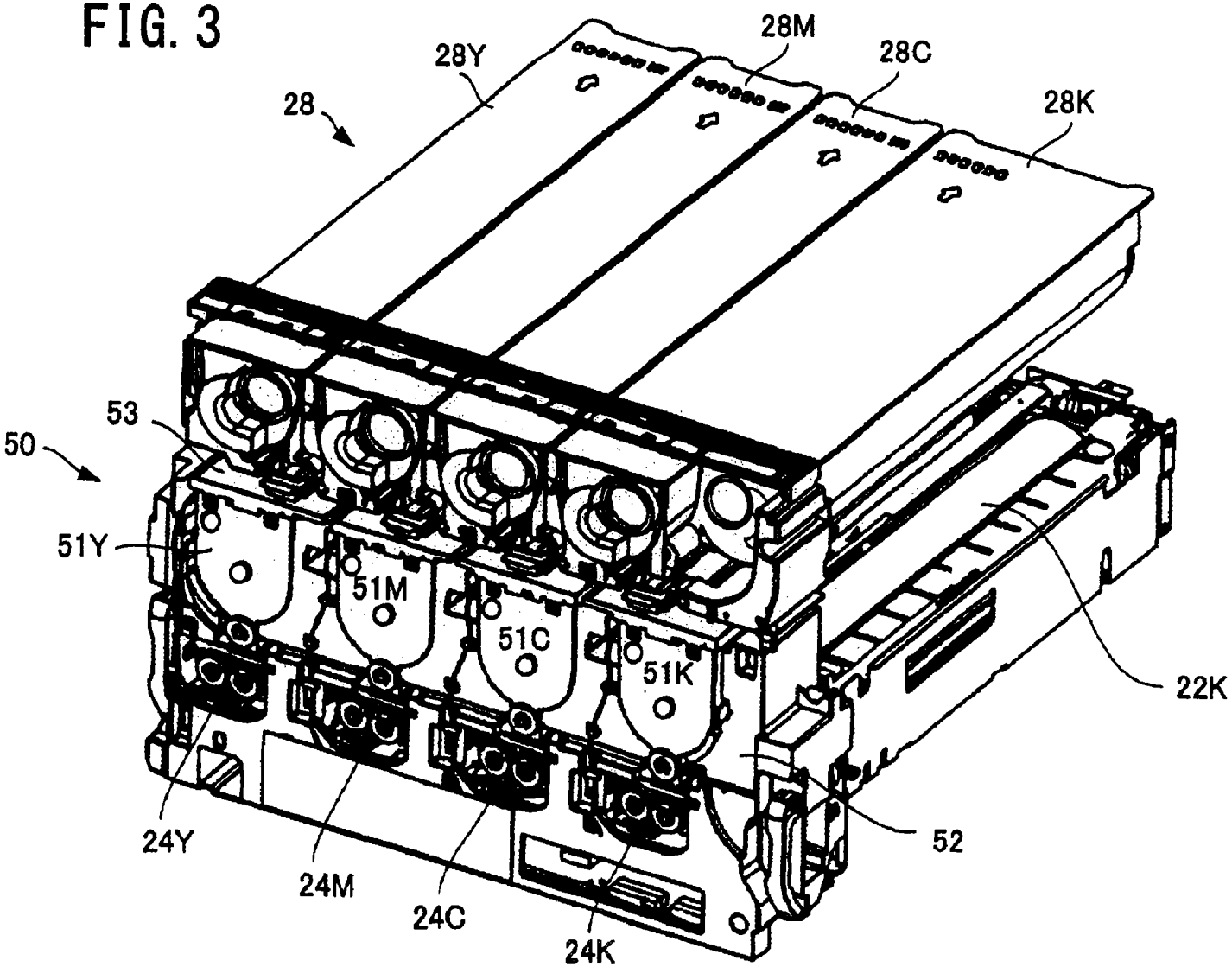
FIG. 3 is a perspective view of a toner supplying apparatus in the image forming apparatus according to the embodiment.

FIG. 3 is a perspective view of a configuration of a main part of a toner supplying apparatus 50 according to this embodiment. The toner supplying apparatus 50 includes sub-hoppers 51 provided between the toner cartridges 28 and developing devices 24. In FIG. 3, the toner cartridges 28Y, 28M, 28C, and 28K for yellow (Y), magenta (M), cyan (C), and black (K) are arranged in parallel in an upper stage, the developing devices 24Y, 24M, 24C, and 24K are arranged in parallel in a lower stage, and the sub-hoppers 51Y, 5M, 51C, and 51K are arranged in a middle stage between the toner cartridges 28 and the developing devices 24. In the figure, the intermediate transfer belt 21 and the primary transfer roller 25 are not shown.

The four toner cartridges 28, the four developing devices 24, and the four sub-hoppers 51 are provided in association with the respective colors of yellow (Y), magenta (M), cyan (C), and black (K). Therefore, in the figures, signs Y, M, C, and K are affixed to the toner cartridges 28, the developing devices 24, and the sub-hoppers 51. However, in the following explanation, the signs Y, M, C, and K may be omitted.

Toners are fed to the sub-hoppers 51 from the toner cartridges 28. The toners in the sub-hoppers 51 are fed to the developing devices 24. Therefore, even if there is no toner in the toner cartridges 28, it is possible to perform printing using the toners in the sub-hoppers 51. It is possible to replace the toner cartridges 28 during the operation of the printer unit 17. The sub-hoppers 51Y, 51M, 51C, and 51K are attached to a supporting member 52.

Figure 4:
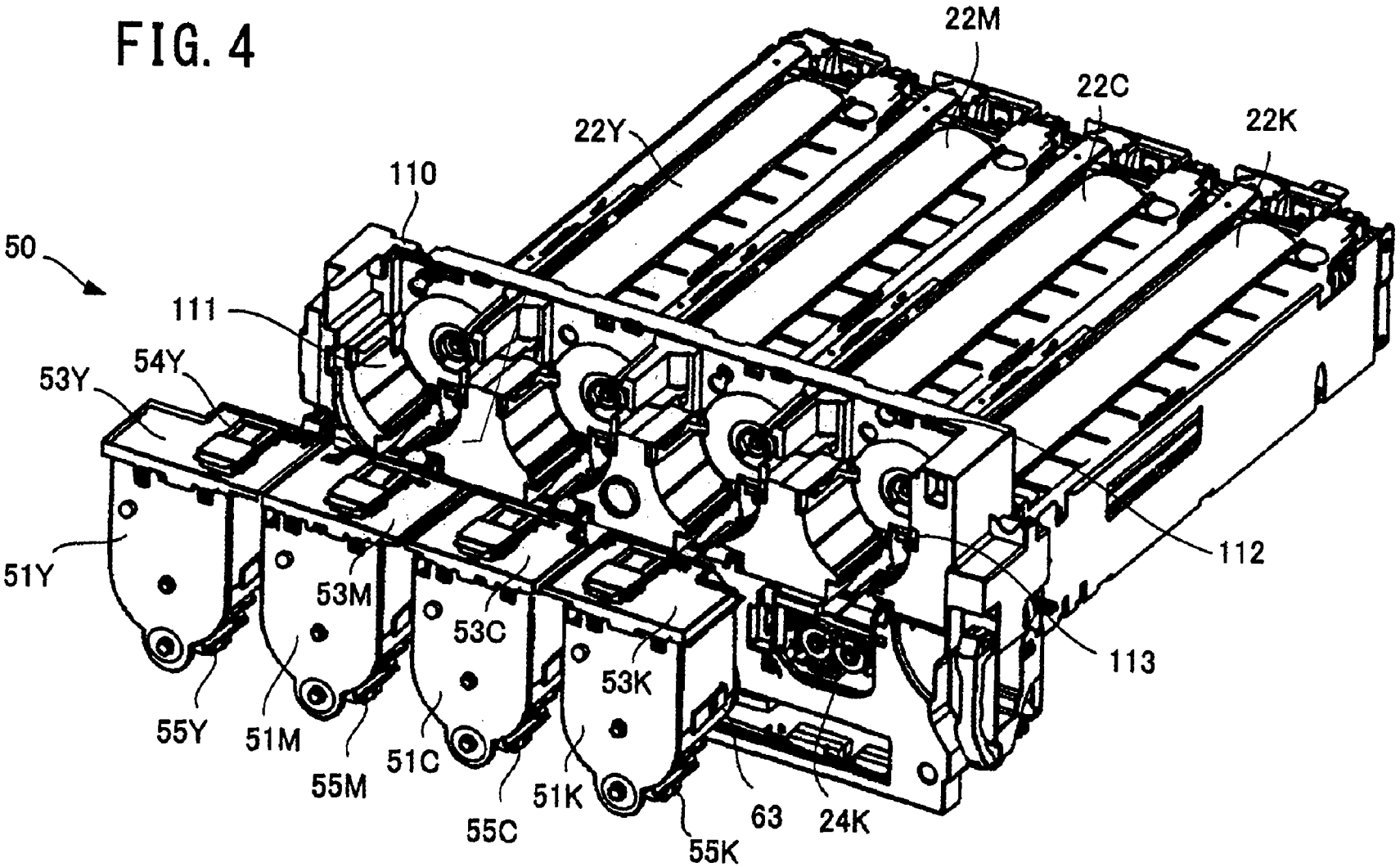
FIG. 4 is a disassembled perspective view of the structure of sub-hoppers of the toner supplying apparatus.

FIG. 4 is a diagram of a state in which the sub-hoppers 51Y, 51M, 51C, and 51K are removed from a frame 110 of the main body 11. The sub-hoppers 51Y, 51M, 51C, and 51K are attached to the supporting member 52. However, the supporting member 52 can be omitted. In FIG. 4, the supporting member 52 is omitted.

The sub-hoppers 51 can be detachably attached to the frame 110 provided above the developing devices 24. The frame 110 detachably holds the sub-hoppers 51 and has recesses 111 in which the sub-hoppers 51Y, 51M, 51C, and 51K are housed, respectively.

The sub-hoppers 51 have covers 53 that cover sub-hopper main body units. Toner receiving ports 54 are formed in the covers 53. Toners fed from the toner cartridges 28Y, 28M, 28C, and 28K are stored in the sub-hoppers 51 via the toner receiving ports 54.

Toner supply ports 55 are provided at lower ends of the sub-hoppers 51. The toners in the sub-hoppers 51 are fed to the developing devices 24 via the toner supply ports 55. Agitating devices (not shown) that agitate the stored toners are provided in the sub-hoppers 51.

Toner receiving ports 54Y, 54M, 54C, and 54K formed in the covers 53 of the sub-hoppers 51Y, 51M, 51C, and 51K are located in positions opposed to toner discharging ports (not shown) of the toner cartridges 28Y, 28M, 28C, and 28K. The toner receiving ports 54Y, 54M, 54C, and 54K are explained in detail later.

The toners in the toner cartridges 28Y, 28M, 28C, and 28K are fed to the sub-hoppers 51Y, 51M, 51C, and 51K via the toner receiving ports 54. The toners of the respective colors are fed from the sub-hoppers 51Y, 51M, 51C, and 51K to the developing devices 24Y, 24M, 24C, and 24K via the toner supply ports 55Y, 55M, 55C, and 55K. Therefore, since the toners in the sub-hoppers 51 can be fed to the developing devices 24 when the toner cartridges 28 are replaced, it is possible to actuate the printer unit 17 and continue printing while the toner cartridges 28 are replaced.

Figure 5A:
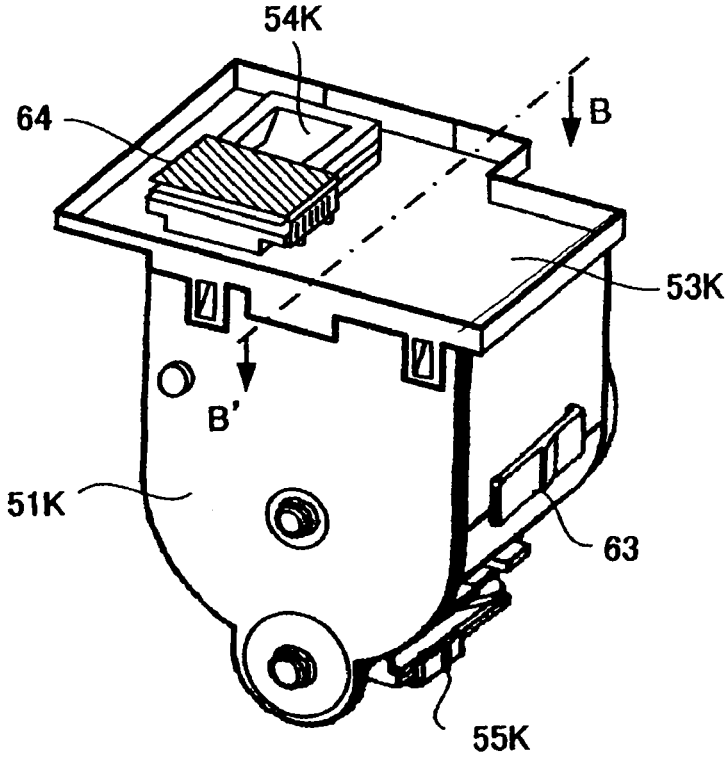
FIG. 5A is an enlarged perspective view of one of the sub-hoppers.

FIG. 5A is an enlarged diagram of a configuration of the sub-hopper 51K for black among the sub-hoppers 51. In the sub-hopper 51K, the cover 53K is attached to an upper surface of a main body, the toner receiving port 54K is formed in the cover 53K, and the toner supply port 55K is provided in a lower surface.

Figure 5B:
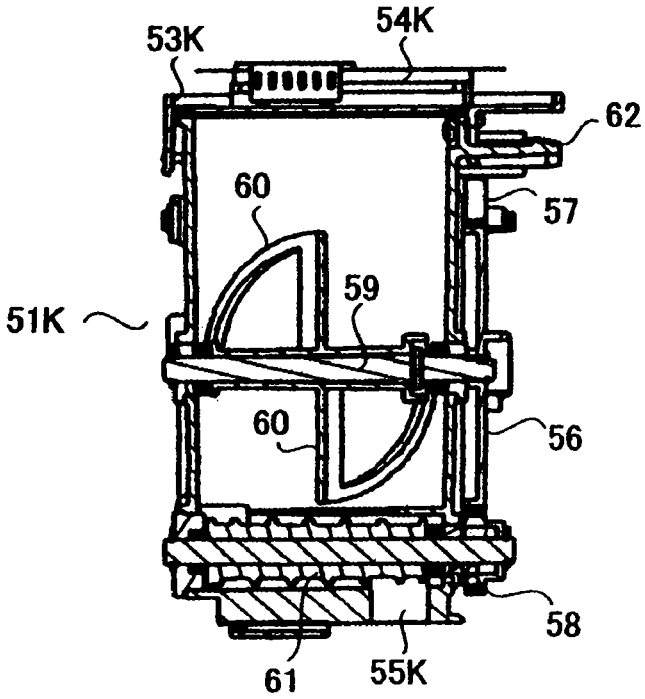
FIG. 5B is a sectional view taken along a B-B' line in FIG. 5A.

FIG. 5B is a sectional view take along a B-B' line in FIG. 5A. A circular gear 56 having a large diameter is attached to the back of the sub-hopper 51K. Two gears 57 and 58 having small diameters that mesh with the gear 56 are provided on the back. The gear 56 is rotated by a driving motor (not shown) provided in the main body. The gears 57 and 58 are rotated according to the rotation of the gear 56.

A mixer 60 that agitates a toner is attached to a rotating shaft 59 of the gear 56. The mixer 60 rotates to agitate the toner in the sub-hopper 51K. A screw 61 that carries the toner to the supply port 55K is attached to the gear 58.

The gear 58 is a one-way gear. When the gear 58 rotates in one direction (regularly rotates), the screw 61 rotates and delivers the toner in the direction of the supply port 55K. When the gear 58 rotates in the opposite direction, rotating force is not transmitted to the screw 61.

When the toner is fed from the sub-hopper 51K to the developing device 24K, the driving motor for the sub-hopper 51K is regularly rotated. When the toner is not fed from the sub-hopper 51K to the developing device 24K and the toner is fed only from the toner cartridge 28K to the sub-hopper 51K, it is possible to feed the toner to the sub-hopper 51K without feeding the toner to the developing device 24K by reversely rotating the driving motor.

An elastic pawl member 62 projecting in the direction of the frame 110 is provided on the back of the sub-hopper 51K. In the frame 110, a slit 112 (see FIG. 4) is formed in a position opposed to the pawl member 62. It is possible to fit the pawl member 62 in the slit 112 when the sub-hopper 51K is attached to the frame 110.

As shown in FIG. 5A, an elastic pawl member 63 is provided on a side of the sub-hopper 51K. In the frame 110, a groove 113 (see FIG. 4) is formed in a position opposed to the pawl member 63. It is possible to fit the pawl member 63 in the groove 113 when the sub-hopper 51K is attached to the frame 110. Therefore, when the sub-hopper 51K is attached to the frame 110, it is possible to attach the sub-hopper 51K with one touch of a finger.

The other sub-hoppers 51Y, 51M, and 51C have the same structure as the sub-hopper 51K except that a shape of the covers 53 is slightly different and a position of the toner receiving ports 54 is different. Main body units of the sub-hoppers 51Y, 51M, 51C, and 51K have the same structure and the toner supply ports 55Y, 55M, 55C, and 55K have the same structure.

Figure 6:
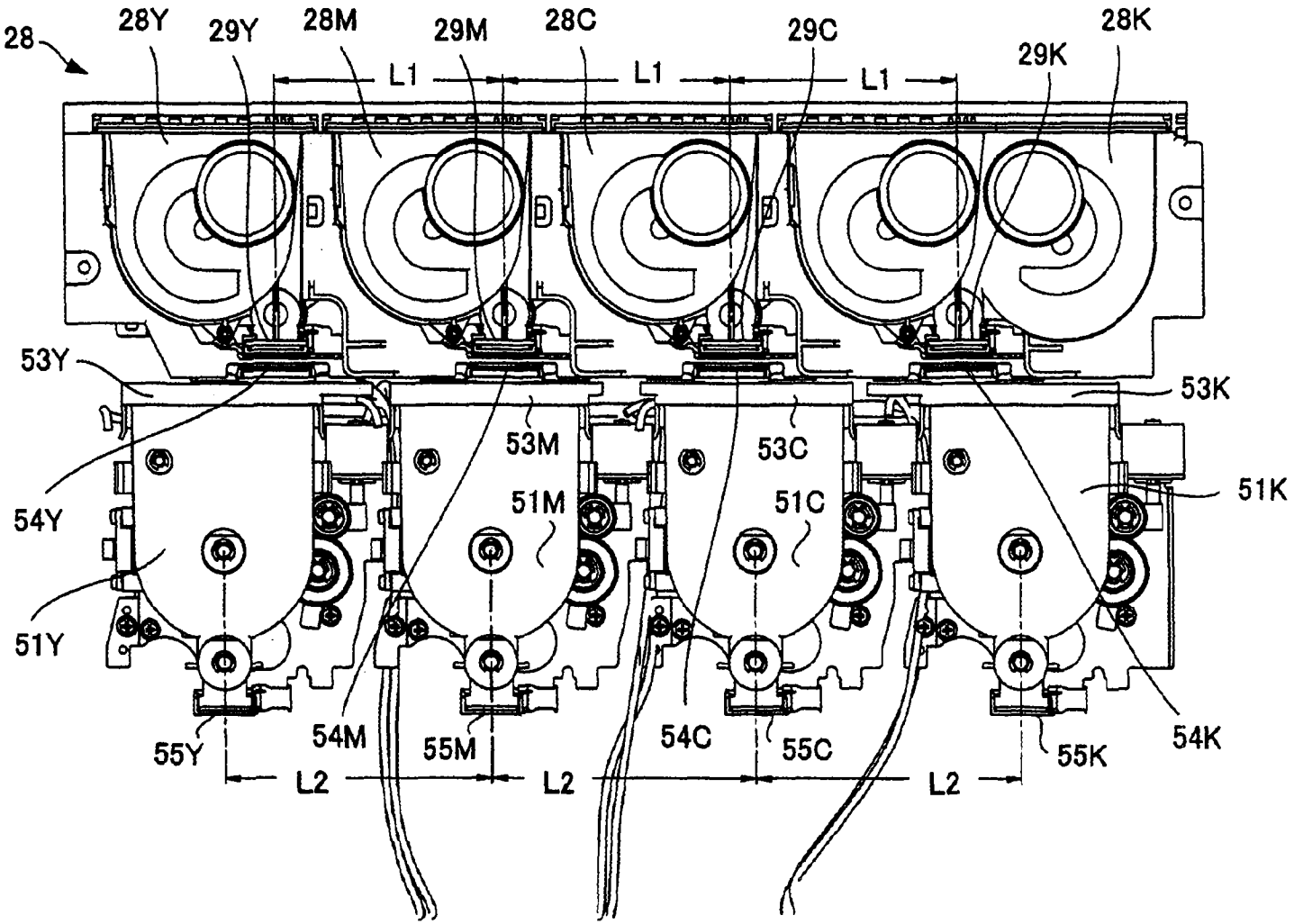
FIG. 6 is a front view for explaining a state in which toner cartridges and the sub-hoppers are attached to a main body unit.

FIG. 6 is a front view for explaining a state in which the toner cartridges 28 and the sub-hoppers 51 are attached to the frame 110 of the main body.

In an example shown in FIG. 6, the toner cartridges 28Y, 28M, and 28C have the same capacity and are arranged adjacent to one another in one horizontal row. The toner cartridge 28K for black has high frequency of use. Therefore, the toner cartridge 28K has the size (capacity) larger than that of the other toner cartridges 28Y, 28M, and 28C and is adjacent to the toner cartridge 28C. The respective toner cartridges 28Y 28M, 28C, and 28K are arranged at a predetermined interval L1 with respect to toner discharging ports 29Y, 29M, 29C, and 29K. The interval L1 is, for example, 90 mm.

The sub-hoppers 51Y, 51M, 51C, and 51K are arranged at an interval L2 same as an arrangement pitch of the developing devices 24Y, 24M, 24C, and 24K in order to feed the toners of the respective colors to the developing devices 24Y, 24M, 24C, and 24K. In other words, the sub-hoppers 51Y, 51M, 51C, and 51K are arranged at the interval of L2 with respect to the toner supply ports 55Y, 55M, 55C, and 55K. The interval L2 is, for example, 105 mm and is larger than the interval L1 (L1<L2).

If the interval L1 among the toner cartridges 28Y, 28M, 28C, and 28K is set equal to the interval L2, since the capacity of the toner cartridge 28K is large, the entire size of the toner cartridges 28 increases. Therefore, it is possible to prevent the increase in size of the toner cartridge 28 by setting L1 smaller than L2. If the intervals L1 and L2 are different, toner feeding paths from the toner cartridges 28 to the sub-hoppers 51 need to be bent and piped and unnecessary components need to be added.

Therefore, as shown in FIG. 6, the positions of the toner receiving ports 54 provided in the covers 53 are shifted for each of the sub-hoppers 51Y, 51M, 51C, and 51K to be opposed to the toner discharging ports 29Y, 29M, 29C, and 29K of the toner cartridges 28Y, 28M, 28C, and 28K. The toner receiving ports 54 are provided right below the toner discharging ports 29.

The toner receiving port 54Y of the sub-hopper 51Y is provided on the sub-hopper 51M side (the right side). The toner receiving port 54K of the sub-hopper 51K is provided on the sub-hopper 51C side (the left side). The toner receiving port 54M of the sub-hopper 51M is provided in a position slightly shifted to the sub-hopper 51C side (the right side) from the center. The toner receiving port 54C of the sub-hopper 51C is provided in a position shifted to the sub-hopper 51M side (the left side).

Therefore, even if the interval L2 and the interval L1 are different, it is possible to directly feed the toners from the toner cartridges 28Y, 28M, 28C, and 28K to the sub-hoppers 51Y, 51M, 51C, and 51K. In the sub-hoppers 51, the shapes of the main body units are the same and the shapes of the toner supply ports 29 are the same. Therefore, the positions of the toner receiving ports 54 only have to be shifted. Additional components are unnecessary.

When the sub-hoppers 51Y, 51M, 51C, and 51K are replaced, the sub-hoppers 51 for wrong colors may be attached. Therefore, as shown in FIG. 5A, the sub-hoppers 51 are colored in colors of shades similar to colors of the toners stored therein. For example, the vicinities 64 of the toner receiving ports 54 are colored. Since the sub-hoppers 51 have the colored sections 64, it is possible to correctly attach the sub-hoppers 51 corresponding to the toner cartridges 28Y, 28M, 28C, and 28K and it is possible to prevent the wrong sub-hoppers 51 from being attached.

According to the embodiment explained above, even if there is no toner in the toner cartridges 28, it is possible to perform printing using the toners in the sub-hoppers 51. It is possible to replace the toner cartridges 28 during the operation of the printer unit 17.

Since the interval L1 among the toner cartridges 28Y, 28M, 28C, and 28K is set smaller than the interval L2 among the sub-hoppers 51Y, 51M, 51C, and 51K, it is possible to reduce the size of the entire apparatus. Even if the interval L1 and the interval L2 are different, it is possible to directly feed the toners from the toner cartridges 28 to the sub-hoppers 51. Moreover, since the shapes of the main body units of the sub-hoppers 51 are the same, the positions of the toner receiving ports 54 only has to be shifted. Additional components are unnecessary. Therefore, even if a toner cartridge having a different capacity is provided, it is possible to reduce kinds of components.

When the sub-hoppers 51 are replaced, it is possible to replace the sub-hoppers 51 in short time without setting the sub-hoppers 51 for wrong colors.

The present invention is not limited to the embodiments and various modifications of the embodiment are possible. For example, in the example explained above, the toner cartridges for four colors of Y, M, C, and K are used as the toner cartridges 28. However, plural toner cartridges for colors other than the four colors may be used. In the example explained above, the system employing the intermediate transfer belt 21 is explained. However, a system not employing the intermediate transfer belt 21 may be adopted.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. An image forming apparatus, comprising:

plural developing devices that develop electrostatic latent images formed on image bearing members;

plural toner cartridges that store toners to be fed to the plural developing devices and have toner discharging ports, at least one of the plural toner cartridges having a size larger than that of the other plural toner cartridges and the plural toner cartridges being arranged such that the toner discharging ports are adjacent to one another at a first interval smaller than an arrangement pitch of the plural developing devices; and plural sub-hoppers that respectively have toner receiving ports formed in positions opposed to the toner discharging ports of the plural toner cartridges and have toner supply ports for feeding the toners to the plural developing devices, the plural sub-hoppers being arranged such that the toner supply ports are adjacent to one another at a second interval same as the arrangement pitch of the plural developing devices.

2. The apparatus of claim 1, wherein the plural sub-hoppers are arranged above the plural developing devices, and the plural toner cartridges are arranged above the plural sub-hoppers.

3. The apparatus of claim 2, wherein in the plural sub-hoppers, main body units thereof have a same shape and the toner supply ports have a same shape, and the plural sub-hoppers have covers in which positions of the toner receiving ports are different.

4. The apparatus of claim 2, wherein the toner receiving ports of the plural sub-hoppers are located right below the toner discharging ports of the plural toner cartridges.

5. The apparatus of claim 1, wherein the plural sub-hoppers have colored sections having colors of shades similar to colors of toners stored in the plural sub-hoppers.

6. The apparatus of claim 1, wherein the plural toner cartridges store toners of colors different from one another, a first toner cartridge that stores a black toner has the larger size, and the plural toner cartridges other than the first toner cartridge have a same shape.

7. A toner supplying apparatus that feeds toners to plural developing devices arranged at a fixed interval, the toner supplying apparatus comprising:

plural toner cartridges that store toners of different colors, respectively, and have toner discharging ports, at least one of the plural toner cartridges having a size larger than that of the other plural toner cartridges and the plural toner cartridges being arranged such that the toner discharging ports are adjacent to one another at a first interval smaller than an arrangement pitch of the plural developing devices; and plural sub-hoppers that respectively have toner receiving ports formed in positions opposed to the toner discharging ports of the plural toner cartridges and have toner supply ports for feeding the toners to the plural developing devices, the plural sub-hoppers being arranged such that the toner supply ports are adjacent to one another at a second interval same as the arrangement pitch of the plural developing devices.

8. The apparatus of claim 7, wherein the plural sub-hoppers are arranged above the plural developing devices, and the plural toner cartridges are arranged above the plural sub-hoppers.

9. The apparatus of claim 8, wherein in the plural sub-hoppers, main body units thereof have a same shape and the toner supply ports have a same shape, and the plural sub-hoppers have covers in which positions of the toner receiving ports are different.

10. The apparatus of claim 8, wherein the toner receiving ports of the plural sub-hoppers are located right below the toner discharging ports of the plural toner cartridges.

11. The apparatus of claim 7, wherein the plural sub-hoppers have colored sections having colors of shades similar to colors of toners stored in the plural sub-hoppers.

12. The apparatus of claim 7, wherein the plural toner cartridges store toners of colors different from one another, a first toner cartridge that stores a black toner has the larger size, and the plural toner cartridges other than the first toner cartridge have a same shape.

13. A toner supplying method for an image forming apparatus, comprising:

providing plural sub-hoppers that supply toners to plural developing devices arranged at a fixed interval;

arranging plural toner cartridges, which store toners of different colors and have toner discharging ports, such that the toner discharging ports are adjacent to one another at a first interval smaller than an arrangement pith of the plural developing devices, at least one of the plural toner cartridges having size larger than that of the other plural toner cartridges;

providing toner receiving ports in the plural sub-hoppers to be opposed to the toner discharging ports;

providing, in the plural sub-hoppers, toner supply ports for feeding the toners to the plural developing devices;

arranging the plural sub-hoppers such that the toner supply ports are adjacent to one another at a second interval same as the arrangement pitch of the plural developing devices;

feeding the toners from the plural toner cartridges to the plural sub-hoppers via the toner receiving ports; and supplying the toners from the plural sub-hoppers to the plural developing devices via the toner supply ports.

14. The method of claim 13, wherein the plural sub-hoppers are arranged above the plural developing devices, and the plural toner cartridges are arranged above the plural sub-hoppers.

15. The method of claim 14, wherein in the plural sub-hoppers, the toner receiving ports are provided in covers that cover main body units of the plural sub-hoppers, and positions of the toner receiving ports are varied according to the toner discharging ports of the plural toner cartridges.

16. The method of claim 13, wherein the plural sub-hoppers are colored in colors of shades similar to colors of toners stored in the plural sub-hoppers.

17. An image forming apparatus comprising:

plural developing devices that develop electrostatic latent images formed on image bearing members;

plural toner cartridges that store toners to be fed to the plural developing devices and have toner discharging ports, a toner cartridge for black having a size larger than that of the other plural toner cartridges and the plural toner cartridges being arranged such that the toner discharging ports are adjacent to one another at a first interval smaller than an arrangement pitch of the plural developing devices; and plural sub-hoppers that respectively have toner receiving ports formed in positions opposed to the toner discharging ports of the plural toner cartridges and have toner supply ports for feeding the toners to the plural developing devices, the plural sub-hoppers being arranged such that the toner supply ports are adjacent to one another at a second interval same as the arrangement pitch of the plural developing devices.

18. The apparatus of claim 17, wherein the plural sub-hoppers are arranged above the plural developing devices, and the plural toner cartridges are arranged above the plural sub-hoppers.

19. The apparatus of claim 17, wherein the plural sub-hoppers have colored sections having colors of shades similar to colors of toners stored in the plural sub-hoppers.

* * * * *